US008966903B2

(12) United States Patent
Bobba et al.

(10) Patent No.: US 8,966,903 B2
(45) Date of Patent: Mar. 3, 2015

(54) COMBUSTOR RESONATOR WITH NON-UNIFORM RESONATOR PASSAGES

(75) Inventors: Mohan Krishna Bobba, Greenville, SC (US); Kwanwoo Kim, Cincinnati, OH (US); Patrick Benedict Melton, Horse Shoe, NC (US); Carolyn Ashley Antoniono, Greenville, SC (US)

(73) Assignee: General Electric Company, Schenectady, NY (US)

( * ) Notice: Subject to any disclaimer, the term of this patent is extended or adjusted under 35 U.S.C. 154(b) by 809 days.

(21) Appl. No.: 13/212,105

(22) Filed: Aug. 17, 2011

(65) Prior Publication Data

US 2013/0042619 A1 Feb. 21, 2013

(51) Int. Cl.
*F02C 7/24* (2006.01)
*F23R 3/00* (2006.01)

(52) U.S. Cl.
CPC ..... *F23R 3/002* (2013.01); *F23M 99/005* (2013.01); *F23R 2900/00014* (2013.01)
USPC ..... 60/725; 60/752; 431/114

(58) Field of Classification Search
USPC ..... 60/725, 752; 431/114; 181/213, 229
See application file for complete search history.

(56) References Cited

U.S. PATENT DOCUMENTS 3,840,326 A * 10/1974 Schreter ..... 431/114
3,850,261 A 11/1974 Hehmann et al.
4,702,073 A * 10/1987 Melconian ..... 60/39.464
5,096,010 A 3/1992 Ojala et al.
5,349,141 A 9/1994 Horibe et al.
5,373,695 A * 12/1994 Aigner et al. ..... 60/804
5,388,412 A * 2/1995 Schulte-Werning et al. ... 60/760
5,431,018 A 7/1995 Keller
5,644,918 A 7/1997 Gulati et al.
5,685,157 A 11/1997 Pandalai et al.
5,771,851 A 6/1998 McLean
5,894,823 A 4/1999 Lee
6,530,221 B1 3/2003 Sattinger et al.
6,695,094 B2 * 2/2004 Moffat et al. ..... 181/249
6,758,304 B1 7/2004 McLean
6,792,907 B1 * 9/2004 Kostun et al. ..... 123/184.57
6,820,431 B2 11/2004 McManus et al.
6,907,736 B2 * 6/2005 Ohnishi et al. ..... 60/725
6,920,758 B2 * 7/2005 Matsuyama et al. ..... 60/725
6,923,002 B2 8/2005 Crawley et al.
6,938,601 B2 9/2005 Fukumoto
7,080,514 B2 * 7/2006 Bland et al. ..... 60/725

(Continued)

FOREIGN PATENT DOCUMENTS

DE 4414232 10/1995
DE 10004991 8/2001

(Continued)

OTHER PUBLICATIONS

Search Report and Written Opinion from EP Application No. 12180001.5 dated Jan. 28, 2013.

(Continued)

*Primary Examiner* — Ehud Gartenberg
*Assistant Examiner* — Lorne Meade
(74) *Attorney, Agent, or Firm* — Fletcher Yoder, P.C.

(57) ABSTRACT

Certain embodiments of the present disclosure include a combustor resonator having a non-uniform annulus between a combustor assembly and a resonator shell. The combustor resonator may further include resonator necks or passages having non-uniform lengths and geometries.

13 Claims, 6 Drawing Sheets

(56) References Cited

U.S. PATENT DOCUMENTS

| | | | | |
|---|---|---|---|---|
| 7,080,515 | B2 * | 7/2006 | Wasif et al. | 60/737 |
| 7,089,741 | B2 * | 8/2006 | Ikeda et al. | 60/725 |
| 7,104,065 | B2 * | 9/2006 | Benz et al. | 60/725 |
| 7,117,974 | B2 | 10/2006 | Moenssen et al. | |
| 7,461,719 | B2 | 12/2008 | Tobik et al. | |
| 7,464,552 | B2 | 12/2008 | Sattinger | |
| 7,549,506 | B2 | 6/2009 | Sattinger | |
| 7,661,267 | B2 | 2/2010 | Pollarolo | |
| 7,788,926 | B2 * | 9/2010 | Johnson et al. | 60/725 |
| 8,464,536 | B2 * | 6/2013 | Bottcher et al. | 60/725 |
| 8,621,842 | B2 * | 1/2014 | Francisco et al. | 60/39.83 |
| 2002/0000343 | A1 | 1/2002 | Paschereit et al. | |
| 2002/0104707 | A1 | 8/2002 | Moffat et al. | |
| 2006/0059913 | A1 | 3/2006 | Bethke et al. | |
| 2008/0041058 | A1 | 2/2008 | Johnson et al. | |
| 2008/0173271 | A1 | 7/2008 | Prior et al. | |
| 2008/0245337 | A1 | 10/2008 | Bandaru et al. | |
| 2010/0011769 | A1 | 1/2010 | Gambacorta et al. | |
| 2010/0212999 | A1 * | 8/2010 | Marion et al. | 181/250 |
| 2011/0179795 | A1 | 7/2011 | Johnson et al. | |

FOREIGN PATENT DOCUMENTS

| | | | |
|---|---|---|---|
| EP | 0236625 | A2 | 9/1987 |
| EP | 0974788 | | 1/2000 |
| EP | 1085201 | | 3/2001 |
| EP | 1557609 | | 7/2005 |
| EP | 1669670 | A1 | 6/2006 |
| JP | 8158964 | A | 6/1996 |
| JP | 9126074 | A | 5/1997 |

OTHER PUBLICATIONS

U.S. Appl. No. 12/960,422, filed Dec. 3, 2010, Swanand Vijay Sardeshmukh.

U.S. Appl. No. 13/189,085, filed Jul. 22, 2011, Kwanwoo Kim, et al.

* cited by examiner

FIG. 1
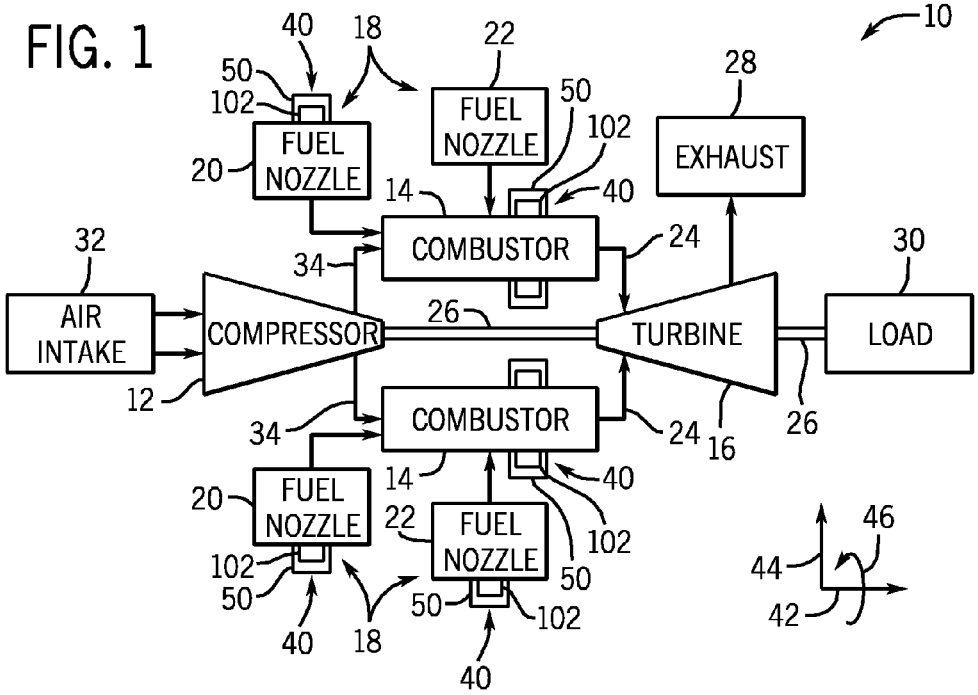
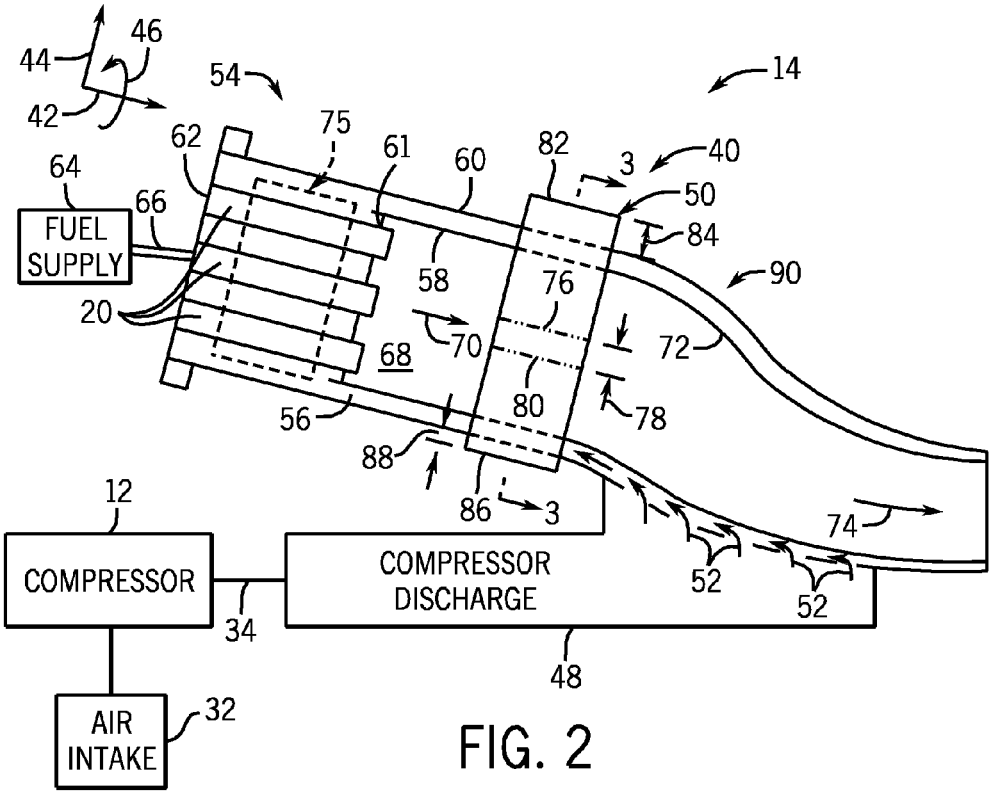
FIG. 2

COMBUSTOR RESONATOR WITH NON-UNIFORM RESONATOR PASSAGES

BACKGROUND OF THE INVENTION

The subject matter disclosed herein relates to combustor assemblies and, more particularly, to a combustor resonator.

Gas turbine systems typically include at least one gas turbine engine having a compressor, a combustor assembly, and a turbine. The combustor assembly may use dry, low NOx (DLN) combustion. In DLN combustion, fuel and air are pre-mixed prior to ignition, which lowers emissions. However, the lean pre-mixed combustion process is susceptible to flow disturbances and acoustic pressure waves. More particularly, flow disturbances and acoustic pressure waves could result in self-sustained pressure oscillations at various frequencies. These pressure oscillations may be referred to as combustion dynamics. Combustion dynamics can cause structural vibrations, wearing, and other performance degradations.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a combustor assembly and an annular resonator shell disposed radially about the combustor assembly. The annular resonator shell has an annular outer wall. A distance between the annular outer wall and the combustor assembly is non-uniform.

In a second embodiment, a combustor resonator includes a flow sleeve and a resonator shell disposed about the flow sleeve. The resonator shell comprises an outer wall, and a distance between the outer wall and the flow sleeve is non-uniform.

In a third embodiment, a combustor resonator includes an inner annular wall and an outer annular wall disposed about the inner annular wall. A distance between the annular outer wall and the inner annular wall is non-uniform.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 1 is a block diagram of an embodiment of a gas turbine system including combustor assemblies, which each may include a combustor resonator having a resonator shell with a distance between the combustor assembly and the resonator shell that is non-uniform;

FIG. 2 is a schematic diagram of an embodiment of one of the combustor assemblies of FIG. 1, including a combustor resonator having a distance between the resonator shell and the combustor assembly that is non-uniform;

DETAILED DESCRIPTION OF THE INVENTION

Figure 3:
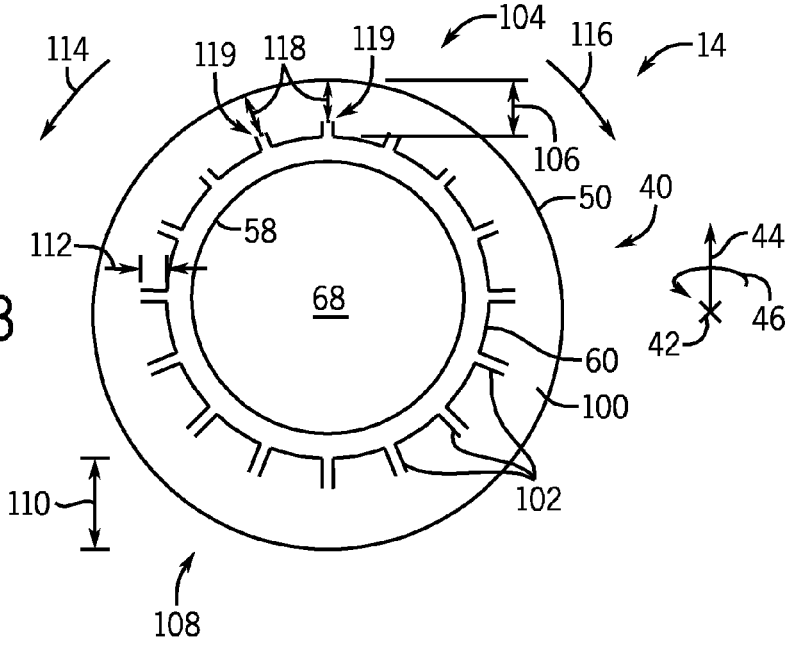
FIG. 3 is a cross-sectional side view of an embodiment of the combustor resonator of FIG. 2, illustrating a resonator shell having a distance between the resonator shell and the combustor assembly that is non-uniform, and resonator necks having lengths among the resonator necks that are non-uniform.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed toward a combustor resonator having a non-uniform annulus between a resonator shell and the combustor. As described above, gas turbine systems include combustor assemblies which may use a DLN or other combustion process that is susceptible to flow disturbances and/or acoustic pressure waves. Specifically, the combustion dynamics of the combustor assembly can result in self-sustained pressure oscillations that may cause structural vibrations, wearing, mechanical fatigue, thermal fatigue, and other performance degradations in the combustor assembly. One technique used to mitigate combustion dynamics is the use of a resonator, such as a Helmholtz resonator. Specifically, a Helmholtz resonator is a damping mechanism that includes several narrow tubes, necks, or other passages connected to a large volume. The resonator operates to attenuate and absorb the combustion tones produced by the combustor assembly. The depth of the necks or passages and the size of the large volume enclosed by the resonator may be related to the frequency of the acoustic waves for which the resonator is effective.

As described herein, the volume enclosed by the resonator, as well as the sizes and depths of the resonator necks or passages, may be varied to adjust the frequency range over which the resonator effectively attenuates and absorbs acoustic pressure waves produced by the combustor assembly. Certain embodiments of the present disclosure include a combustor resonator having an annulus with a non-uniform height. For example, in one embodiment, the combustor resonator includes a resonator shell disposed about a flow sleeve of the combustor assembly, wherein the annulus between the flow sleeve and the resonator shell may be non-uniform. The combustor resonator may also include a plurality of resonator necks or passages connecting the flow sleeve of the combustor assembly to the annulus between the flow sleeve and the resonator shell. In certain embodiments, the resonator necks or passages may also be non-uniform. Specifically, the lengths that the resonator necks or passages extend into the annulus of the combustor resonator may vary between the resonator necks or passages disposed around the circumference of the flow sleeve. Moreover, the diameters of the resonator necks or passages may also vary between the resonator necks or passages disposed around the circumference of the flow sleeve. In other embodiments, the resonator shell may be disposed about other areas of the combustor assembly, such as fuel nozzles of the combustor assembly. As described in greater detail below, the non-uniform height of the annulus and the non-uniform heights and diameters of the resonator necks or passage may help widen the frequency ranges over which the combustor resonator may be effective. As will be appreciated, embodiments of the present disclosure may include an annulus with a non-uniform height, non-uniform resonator necks or passages, or both in combination.

Turning now to the drawings, FIG. 1 illustrates a block diagram of an embodiment of a gas turbine system 10. The diagram includes a compressor 12, combustor assemblies 14, and a turbine 16. In the following discussion, reference may be made to an axial direction or axis 42, a radial direction or axis 44, and a circumferential direction or axis 46 of the combustor 14. The combustor assemblies 14 include fuel nozzles 18 which route a liquid fuel and/or gas fuel, such as natural gas or syngas, into the combustor assemblies 14. As illustrated, each combustor assembly 14 may have multiple fuel nozzles 18. More specifically, the combustor assemblies 14 may each include a primary fuel injection system having primary fuel nozzles 20 and a secondary fuel injection system having secondary fuel nozzles 22. As described in detail below, a combustor resonator 40 (e.g., annular resonator and/or turbine combustor resonator) is coupled to each combustor assembly 14, wherein the resonator 40 has an annular chamber defined by an annular resonator shell 50 partially extending around the combustor 14. The resonator 40 may also include resonator necks 102 or resonator passages 208 extending into the annular chamber. Similarly, the primary and secondary fuel nozzles 20 and 22 may include resonators 40 having annular resonator shells 50 and resonator necks 102 or resonator passages 208. As discussed below, the resonator 40 has a non-uniform height of the annular chamber, a non-uniform length among the necks or passages, and/or a non-uniform diameter among the resonator necks or passages to widen the frequency range of the resonator 40.

The combustor assemblies 14 illustrated in FIG. 1 ignite and combust an air-fuel mixture, and then pass hot pressurized combustion gasses 24 (e.g., exhaust) into the turbine 16. Turbine blades are coupled to a common shaft 26, which is also coupled to several other components throughout the turbine system 10. As the combustion gases 24 pass through the turbine blades in the turbine 16, the turbine 16 is driven into rotation, which causes the shaft 26 to rotate. Eventually, the combustion gases 24 exit the turbine system 10 via an exhaust outlet 28. Further, the shaft 26 may be coupled to a load 30, which is powered via rotation of the shaft 26. For example, the load 30 may be any suitable device that may generate power via the rotational output of the turbine system 10, such as a power generation plant or an external mechanical load. For instance, the load 30 may include an electrical generator, a propeller of an airplane, and so forth.

In an embodiment of the turbine system 10, compressor blades are included as components of the compressor 12. The blades within the compressor 12 are also coupled to the shaft 26, and will rotate as the shaft 26 is driven to rotate by the turbine 16, as described above. The rotation of the blades within the compressor 12 compress air from an air intake 32 into pressurized air 34. The pressurized air 34 is then fed into the fuel nozzles 18 of the combustor assemblies 14. The fuel nozzles 18 mix the pressurized air 34 and fuel to produce a suitable mixture ratio for combustion (e.g., a combustion that causes the fuel to more completely burn) so as not to waste fuel or cause excess emissions.

FIG. 2 is a schematic diagram of an embodiment of one of the combustor assemblies 14 of FIG. 1, illustrating an embodiment of the resonator 40 with an annular resonator shell 50 disposed about the combustor assembly 14. As described above, the compressor 12 receives air from an air intake 32, compresses the air, and produces a flow of pressurized air 34 for use in the combustion process within the combustor 14. As shown in the illustrated embodiment, the pressurized air 34 is received by a compressor discharge 48 that is operatively coupled to the combustor assembly 14. As illustrated by arrows 52, the pressurized air 34 flows from the compressor discharge 48 towards a head end 54 of the combustor 14. More specifically, the pressurized air 34 flows through an annulus 56 between a liner 58 and a flow sleeve 60 of the combustor assembly 14 to reach the head end 54.

In certain embodiments, the head end 54 includes plates 61 and 62 that may support the primary fuel nozzles 20 depicted in FIG. 1. In the embodiment illustrated in FIG. 2, a primary fuel supply 64 provides fuel 66 to the primary fuel nozzles 20. Additionally, the primary fuel nozzles 20 receive the pressurized air 34 from the annulus 56 of the combustor assembly 14. The primary fuel nozzles 20 combine the pressurized air 34 with the fuel 66 provided by the primary fuel supply 64 to form an air/fuel mixture. The air/fuel mixture is ignited and combusted in a combustion zone 68 of the combustor assembly 14 to form combustion gases (e.g., exhaust). The combustion gases flow in a direction 70 toward a transition piece 72 of the combustor assembly 14. The combustion gases pass through the transition piece 72, as indicated by arrow 74, toward the turbine 16, where the combustion gases drive the rotation of the blades within the turbine 16.

The combustor assembly 14 also includes the resonator 40 with the annular resonator shell 50 extending circumferentially 46 around the combustor 14 (e.g., around the flow sleeve 60). In other words, the resonator 40 comprises an inner annular wall (e.g., the flow sleeve 60) and an outer annular wall (e.g., the annular resonator shell 50) disposed about the inner annular wall. In other embodiments, the inner annular wall of the resonator 40 may include the primary fuel nozzles 20 or the secondary fuel nozzles 22. As described above, the combustion process produces a variety of pressure waves, acoustic waves, and other oscillations referred to as combustion dynamics. Combustion dynamics may cause performance degradation, structural stresses, and mechanical or thermal fatigue in the combustor assembly 14. Therefore, combustor assemblies 14 may include the resonator 40, e.g., a Helmholtz resonator, to help mitigate the effects of combustion dynamics in the combustor assembly 14. In the illustrated embodiment, the annular resonator shell 50 of the resonator 40 extends completely around the flow sleeve 60 of the combustor assembly 14. In other embodiments, the annular resonator shell 50 may be used in other locations within the combustor assembly 14. For example, the annular resonator shell 50 may be disposed around the primary fuel nozzles 20, as indicated by reference numeral 75.

The annular resonator shell 50 is a generally cylindrical and hollow structure. As described in detail below, the radial 44 distance between the annular resonator shell 50 and the flow sleeve 60 of the combustor assembly 14 is non-uniform. In other words, a lateral cross-section of the combustor assembly 14 and the annular resonator shell 50 is non-uniform. In the illustrated embodiment, a central axis 76 of the annular resonator shell 50 is offset a distance 78 from a central axis 80 of the combustor assembly 14. As a result, the distance between the annular resonator shell 50 and the flow sleeve 60 of the combustor assembly 14 varies circumferentially 46 about the flow sleeve 60 of the combustor assembly 14. For example, a first portion 82 of an outer wall of the annular resonator shell 50 is disposed a first radial distance 84 from the flow sleeve 60. Additionally, a second portion 86 of the outer wall of the annular resonator shell 50 is disposed a second radial distance 88 from the flow sleeve 60, where the second distance 88 is shorter than the first distance 84. The varying radial 44 distance between the flow sleeve 60 and the annular resonator shell 50 enables the annular resonator shell 50 to absorb oscillations across a wider frequency range than a single resonator with a uniform distance between the annular resonator shell 50 and the flow sleeve 60. Additionally, the non-uniform shape of the annular resonator shell 50 offers the flexibility of accommodating the annular resonator shell 50 in irregular spaces that are common in combustors. For example, the annular resonator shell 50 may be accommodated around a curved portion 90 of the transition piece 72 of the combustor assembly 14, or the annular resonator shell 50 may disposed around the primary fuel nozzles 20. Furthermore, the annular resonator shell 50 may have a variety of different shapes. For example, the annular resonator shell 50 may be circular, oval, rectangular, polygonal, etc.

FIG. 3 is a cross-sectional side view of an embodiment of the combustor assembly 14, taken along line 3-3 of FIG. 2, illustrating an embodiment of the resonator 40 with the annular resonator shell 50 disposed circumferentially 46 about the flow sleeve 60, thereby defining an annulus 100 (e.g., annular resonator chamber) between the annular resonator shell 50 and the flow sleeve 60. Additionally, the flow sleeve 60 includes resonator necks 102 (e.g., tubes, channels, or other passages) extending radially 44 outward from the flow sleeve 60 toward the annular resonator shell 50. In certain embodiments, the resonator necks 102 are welded to the flow sleeve 60. As described above, the annular resonator shell 50 is disposed about the flow sleeve 60 at a radial 44 offset. That is, the flow sleeve 60 and the annular resonator shell 50 are not concentric. Specifically, at a top portion 104 (or one side) of the combustor assembly 14, the annular resonator shell 50 is a first distance 106 radially 44 away from the flow sleeve 60. In other words, the radial height of the annulus 100 at the top portion 104 of the combustor assembly 14 is the first distance 106. At a bottom portion 108 (or other side) of the combustor assembly 14, the annular resonator shell 50 is a second distance 110 radially 44 away from the flow sleeve 60, wherein the second distance 110 is greater than the first distance 106. In other words, the radial height of the annulus 100 at the bottom portion 108 of the combustor assembly 14 is the second distance 110. Because the height of the annulus 100 is greater at the bottom portion 108 than the top portion 104 of the combustor assembly 14, the annulus 100 generally has a greater volume at the bottom portion 108 than at the top portion 104 of the combustor assembly 14. Consequently, the frequency of the oscillations absorbed by the annular resonator shell 50 at the bottom portion 108 may be different than the frequency of the oscillations absorbed by the annular resonator shell 50 at the top portion 104.

In the embodiment illustrated in FIG. 3, the flow sleeve 60 includes resonator necks 102 extending radially 44 outward from the flow sleeve 60 toward the annular resonator shell 50. As described above, the resonator necks 102 may be welded to the flow sleeve 60. Additionally, the geometries of the resonator necks 102 are different between resonator necks 102. Specifically, in the illustrated embodiment, the lengths 112 of the resonator necks 102 are not uniform circumferentially 46 about the flow sleeve 60. As described in detail below, other embodiments of the resonator necks 102 may have other variations in geometry. At the top portion 104 (or one side) of the combustor assembly 14, the lengths 112 of the resonator necks 102 are shorter than the lengths 112 of the resonator necks 102 at the bottom portion 108 (or other side) of the combustor assembly 14. More specifically, the lengths 112 of the resonator necks 102 incrementally increase from the top portion 104 to the bottom portion 108 of the combustor assembly 14 along each side of the flow sleeve 60 (e.g., in a direction 114 and in a direction 116 circumferentially 46 about the flow sleeve 60). As will be appreciated, the specific variation of the lengths 112 of the resonator necks 102 may vary between different embodiments. For example, in other embodiments, the resonator necks 102 with the longer lengths 112 may be located along the top portion 104 of the combustor assembly 14.

Variations in the lengths 112 of the resonator necks 102 may allow the resonator necks 102 to mitigate and absorb different frequencies of combustion dynamics. Specifically, the resonator necks 102 with shorter lengths 112 (e.g., the resonator necks 102 at the top portion 104 of the combustor assembly 14 illustrated in FIG. 3) may generally absorb higher frequency oscillations produced by combustion dynamics. Conversely, the resonator necks 102 with longer lengths 112 (e.g., the resonator necks 102 at the bottom portion 108 of the combustor assembly 14) may generally absorb lower frequency oscillations produced by combustion dynamics. The lengths 112 among the resonator necks 102 may vary by a factor of approximately 1.1 to 20, 1.5 to 10, or 2 to 5 from the shortest neck 102 to the longest neck 102.

Furthermore, in the embodiment illustrated in FIG. 3, the annular resonator shell 50 is positioned about the flow sleeve 60, such that a radial gap (i.e., a radial offset) 118 between a peripheral end 119 of each resonator neck 102 and the annular resonator shell 50 is constant. However, in other embodiments, the gaps 118 between each resonator neck 102 and the annular resonator shell 50 may not be constant. For example, in certain embodiments, the lengths 112 of the resonator necks 102 may vary circumferentially 46 about the flow sleeve 60; however, in contrast to the embodiment illustrated in FIG. 3, the flow sleeve 60 and the annular resonator shell 50 may be concentric. In such an embodiment, the gaps 118 between the resonator necks 102 and the annular resonator shell 50 may vary inversely proportional to variations in the lengths 112 of the resonator necks 102.

Figure 4:
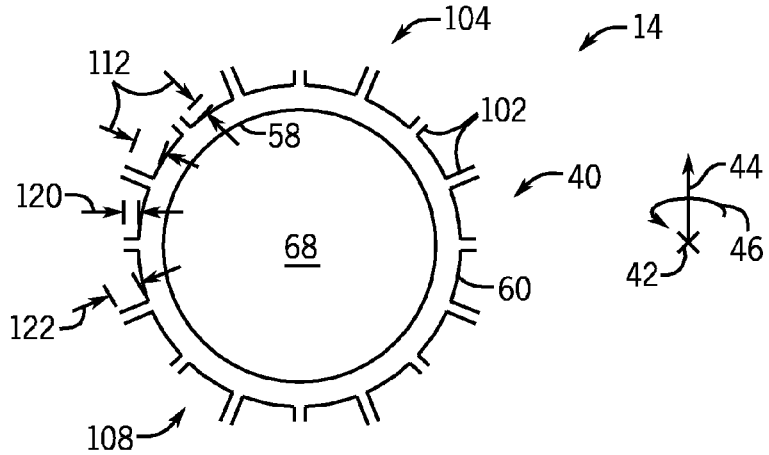
FIG. 4 is a cross-sectional side view of an embodiment of the combustor resonator of FIG. 2, illustrating resonator necks having alternating lengths among the resonator necks.
Figure 5:
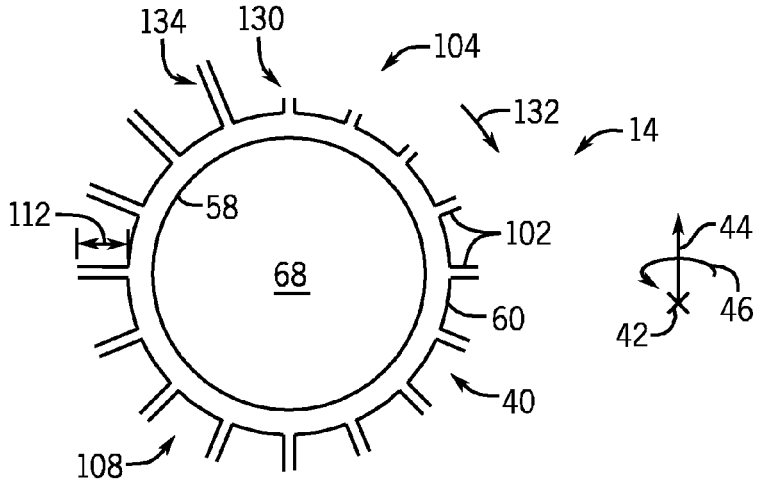
FIG. 5 is a cross-sectional side view of an embodiment of the combustor resonator of FIG. 2, illustrating resonator necks having increasing lengths among the resonator necks.
Figure 6:
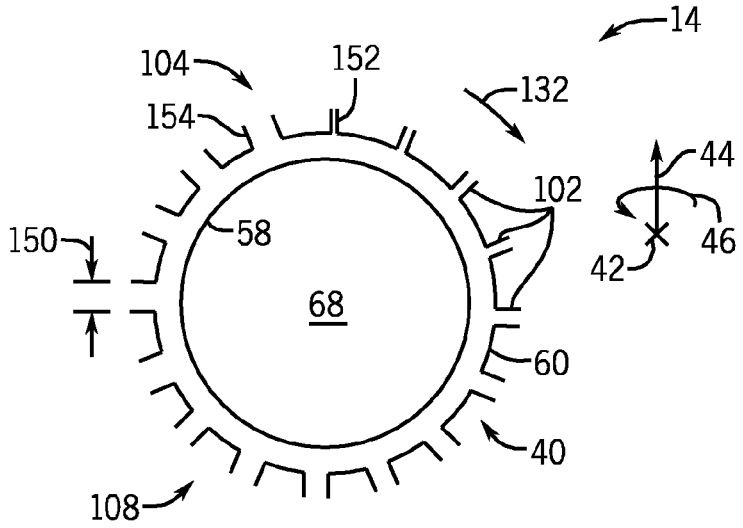
FIG. 6 is a cross-sectional side view of an embodiment of the combustor resonator of FIG. 2, illustrating resonator necks having diameters among the resonator necks that are non-uniform.

FIGS. 4-6 are cross-sectional side views of various embodiments of the combustor assembly 14, taken along line 3-3 of FIG. 2, illustrating various configurations of the resonator necks 102 extending radially outward from the flow sleeve 60. The embodiments illustrated in FIGS. 4-6 include similar elements and element numbers as the embodiment illustrated in FIG. 3. Additionally, while the annular resonator shell 50 is not shown in FIGS. 4-6, the embodiments of the resonator 40 illustrated in FIGS. 4-6 may include the annular resonator shell 50. FIG. 4 illustrates an embodiment of the combustor assembly 14 having resonator necks 102 with lengths 112 that alternate about the circumference of the flow sleeve 60. Specifically, the lengths 112 of the resonator necks 102 alternate between a shorter length 120 and a longer length 122 about the circumference of the flow sleeve 60. For example, in certain embodiments, the shorter length 120 of certain resonator necks 102 may be approximately 0.25 to 0.75, 0.3 to 0.7, 0.4 to 0.6, or 0.45 to 0.5 inches. In certain embodiments, the longer length 122 of certain resonator necks 102 may be approximately 1.25 to 1.75, 1.3 to 1.7, 1.4 to 1.6, or 1.45 to 1.5 inches. Furthermore, in certain embodiments, the longer lengths 122 may be 1.05 to 50, 1.1 to 20, 1.5 to 10, or 2 to 5 times the shorter lengths 120. As will be appreciated, the resonator necks 102 having the shorter length 120 may generally absorb oscillations of a higher frequency than the resonator necks 102 having the longer length 122.

FIG. 5 illustrates a combustor assembly 14 having a flow sleeve 60 with resonator necks 102 extending radially 44 outward from the flow sleeve 60. In the illustrated embodiment, the lengths 112 of the resonator necks 102 incrementally increase circumferentially 46 about of the flow sleeve 60. Specifically, a resonator neck 130 at the top portion 104 of the combustor assembly 14 has the shortest length 112. For example, in certain embodiments, the length 112 of the shortest resonator neck 130 may be approximately 0.25 to 0.75, 0.3 to 0.7, 0.4 to 0.6, or 0.45 to 0.5 inches. In a clockwise direction 132, the length 112 of each subsequent resonator neck 102 gradually increases one after another circumferentially 46 about the flow sleeve 60. In certain embodiments, the increases in the lengths 112 of the resonator necks 102 may be incremental at a constant rate or a variable rate. For example, in certain embodiments, the length 112 of each subsequent resonator neck 102 along the circumference of the flow sleeve 60 may increase by approximately 0.01 to 0.1, 0.02 to 0.8, 0.03 to 0.7, 0.04 to 0.6, or 0.05 to 0.5 inches, until a resonator neck 134 disposed adjacent to the resonator neck 130 has the longest length 112. For example, in certain embodiments, the length 112 of the longest resonator neck 134 may be approximately 1.25 to 1.75, 1.3 to 1.7, 1.4 to 1.6, or 1.45 to 1.5 inches. In other embodiments, the lengths 112 of the resonator necks 102 may have percentage incremental increases. For example, the lengths 112 may increase 1 to 50, 5 to 25, or 10 to 15 percent from one neck 102 to another in a circumferential 46 direction. Further, the length 112 of the longest resonator neck 134 may be 1 to 1000, 2 to 500, 3 to 100, 4 to 50, or 5 to 25 times longer than the shortest resonator neck 130. As will be appreciated, due to the varying lengths 112 of the resonator necks 102, the resonator necks 102 may absorb different frequencies of oscillations produced by combustion dynamics.

FIG. 6 illustrates a combustor assembly 14 having a flow sleeve 60 with resonator necks 102 extending radially 44 outward from the flow sleeve 60. In the illustrated embodiment, the resonator necks 102 have different cross-sectional diameters 150 (i.e., different passage diameters or widths). More specifically, the resonator neck 152 at the top portion 104 of the combustor assembly 14 has the smallest cross-sectional diameter 150. For example, in certain embodiments, the diameter 150 of the most narrow resonator neck 152 may be approximately 0.2 to 1.0, 0.3 to 0.9, 0.4 to 0.8, or 0.5 to 0.7 inches. In the clockwise direction 132, the cross-sectional diameter 150 of each subsequent resonator neck 102 gradually increases one after another circumferentially 46 about the flow sleeve 60. In certain embodiments, the increases among the cross-sectional diameters 150 of the resonator necks 102 may be incremental at a constant rate or a variable rate. For example, in certain embodiments, the cross-sectional diameter 150 of each subsequent resonator neck 102 circumferentially 46 about the flow sleeve 60 may increase by approximately 0.005 to 0.1, 0.01 to 0.9, 0.02 to 0.8, 0.03 to 0.7, 0.04 to 0.6, or 0.05 to 0.5 inches, until a resonator neck 154 disposed adjacent to the resonator neck 152 has the largest cross-sectional diameter 150. For example, in certain embodiments, the cross-sectional diameter 150 of the widest resonator neck 154 may be approximately 1.2 to 2.0, 1.3 to 1.9, 1.4 to 1.8, or 1.5 to 1.7 inches. In other embodiments, the cross-sectional diameters 150 of the resonator necks 102 may have percentage incremental increases. For example, the cross-sectional diameters 150 may increase 1 to 50, 5 to 25, or 10 to 15 percent from one neck 102 to another in a circumferential 46 direction. Further, the cross-sectional diameter 150 of the widest resonator neck 154 may be 1 to 1000, 2 to 500, 3 to 100, 4 to 50, or 5 to 25 times greater than the resonator neck 152. As will be appreciated, due to the varying cross-sectional diameters 150 of the resonator necks 102, the resonator necks 102 may absorb different frequencies of oscillations produced by combustion dynamics.

Figure 7:
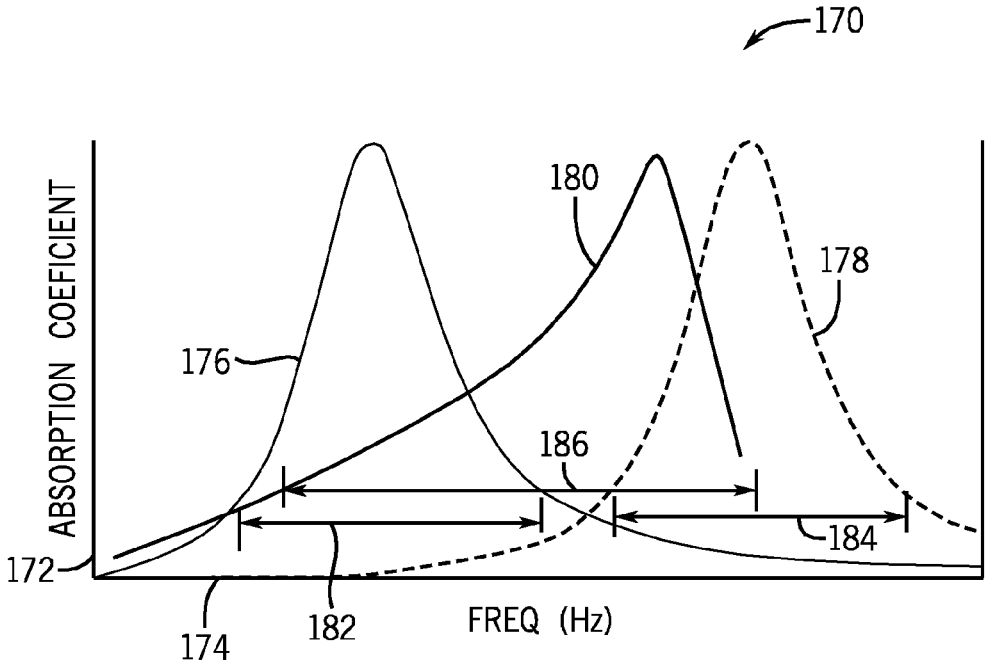
FIG. 7 is a graph illustrating an absorption coefficient for three different embodiments of combustor resonators with respect to the frequency of pressure oscillations.

FIG. 7 is a graph 170 illustrating an absorption coefficient 172 for three different embodiments of resonators 40 for combustor assemblies 14 with respect to a frequency 174 of pressure oscillations produced by combustion dynamics. More specifically, the line 176 represents a relationship between the absorption coefficient 172 and the frequency 174 of pressure oscillations for a combustor assembly 14 where the radial distance from the annular resonator shell 50 to the flow sleeve 60 is constant or uniform. In other words, the annular resonator shell 50 and the flow sleeve 60 are concentric for the combustor assembly 14 represented by the line 176. Specifically, for the combustor assembly 14 represented by line 176, the distance between the annular resonator shell 50 and the flow sleeve 60 is the distance 110 shown in FIG. 3, and the distance 110 is uniform circumferentially 46 about the flow sleeve 60. Additionally, the combustor assembly 14 represented by the line 176 includes resonator necks 102, where each resonator neck 102 has the longer length 122 shown in FIG. 4 (i.e., the resonator necks 102 are uniform and have the length 122), and each resonator neck 102 has the same (i.e., uniform) diameter.

The graph 170 also includes a line 178 which represents the relationship between the absorption coefficient 172 and the frequency 174 of pressure oscillations for a combustor assembly 14 where the distance between the annular resonator shell 50 and the flow sleeve 60 is constant. In particular, the distance between the annular resonator shell 50 and the flow sleeve 60 is the distance 106 shown in FIG. 3, and the distance 106 is uniform circumferentially 46 about the flow sleeve 60. In other words, the annular resonator shell 50 and the flow sleeve 60 are concentric for the combustor assembly 14 represented by the line 178. Additionally, the combustor assembly 14 represented by line 178 includes resonator necks 102, where each resonator neck has the shorter length 120 shown in FIG. 4 (i.e., the resonator necks 102 are uniform and have the length 120), and each resonator neck 102 has the same (i.e., uniform) diameter.

Furthermore, the graph 170 includes a line 180 representing the relationship between the absorption coefficient 172 and the frequency 174 of pressure oscillations for a combustor assembly 14 having the annular resonator shell 50 disposed at an offset around the flow sleeve 60 and resonator necks 102 having different lengths 112. For example, the combustor assembly 14 represented by line 180 may have the annular resonator shell 50 and resonator necks 102 configuration shown in FIG. 3. In other words, the combustor assembly 14 represented by line 180 includes the resonator 40 with a non-uniform annulus 100, non-uniform lengths 112 of the resonator necks 102, and constant cross-sectional diameters 150 of the resonator necks 102.

As shown by the graph 170, the combustor assembly 14 represented by line 176 has an approximate effectiveness range 182. In other words, the approximate effectiveness range 182 represents the range of frequencies 174 across which the resonator 40 of the combustor assembly 14 represented by line 176 (e.g., the combustor assembly 14 where the distance between the annular resonator shell 50 and the flow sleeve is constant and equal to the distance 110 shown in FIG. 3 and where each resonator neck 102 has the longer length 122 shown in FIG. 4) effectively absorbs oscillations produced by combustion dynamics. Similarly, the combustor assembly 14 represented by line 178 (e.g., the combustor assembly where the distance between the annular resonator shell 50 and the flow sleeve 60 is constant and equal to the distance 106 shown in FIG. 3 and where each resonator neck has the shorter length 120 shown in FIG. 4) has an approximate effectiveness range 184. Furthermore, the combustor assembly 14 represented by line 180 has an approximate effectiveness range 186. The approximate effectiveness range 186 of the combustor assembly 14 represented by line 180 (e.g., the combustor assembly 14 having the annular resonator shell 50 offset from the flow sleeve 60 and the resonator necks 102 with non-uniform lengths 112) is greater than the approximate effectiveness ranges 182 and 184 for the combustor assemblies 14 represented by lines 176 and 178. As will be appreciated, the combustor assembly 14 having an off center annular resonator shell 50 and resonator necks 102 with non-uniform lengths 112 may absorb a wider range of frequencies (e.g., range 186) than the combustor assemblies 14 having the annular resonator shell 50 concentric to the flow sleeve 60 and resonator necks 102 with a uniform length 112 (e.g., ranges 182 and 184).

Figure 8:
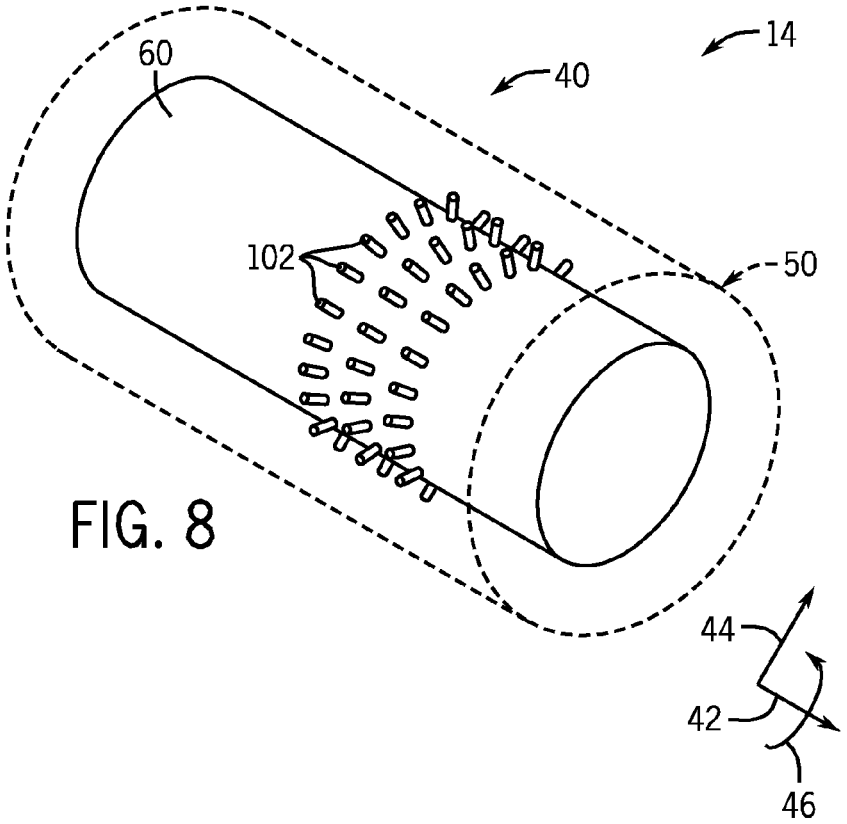
FIG. 8 is a partial perspective view of an embodiment of the combustor resonator of FIG. 2, illustrating three rows of resonator necks disposed on a flow sleeve of the combustor assembly.
Figure 9:
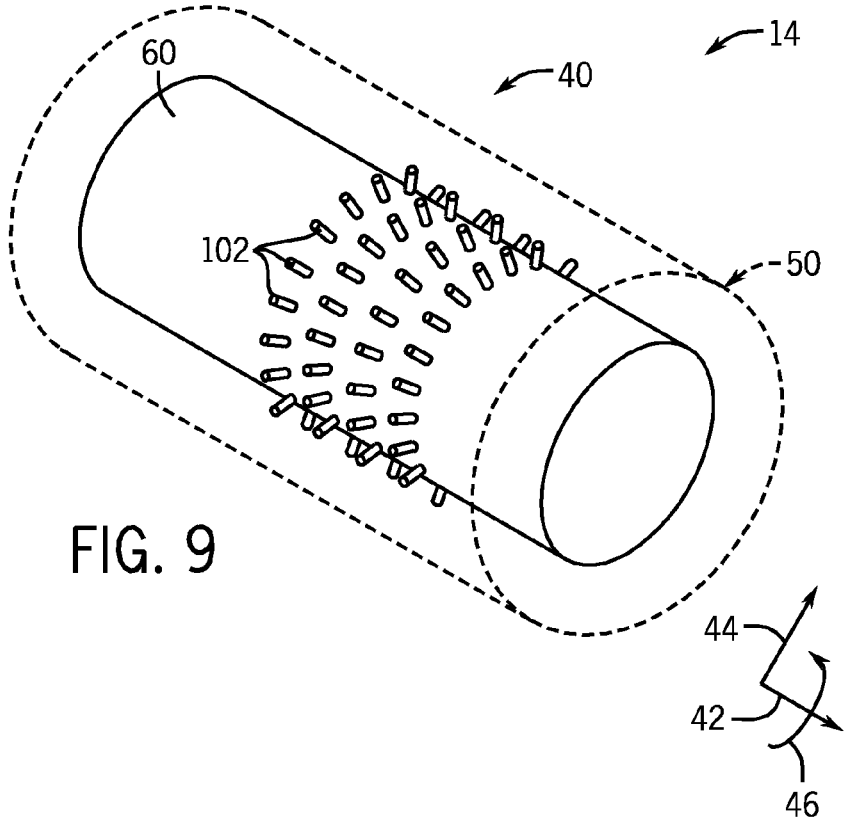
FIG. 9 is a partial perspective view of an embodiment of the combustor resonator of FIG. 2, illustrating four rows of resonator necks having a staggered configuration disposed on a flow sleeve of the combustor assembly.

FIGS. 8 and 9 are partial perspective views of embodiments of the combustor assembly 14 illustrating the flow sleeve 60 having multiple rows of resonator necks 102 extending radially 44 outward from the flow sleeve 60 toward the annular resonator shell 50 (shown in dashed lines). Specifically, FIG. 8 illustrates the flow sleeve 60 having three rows of resonator necks 102 extending radially 44 outward from the flow sleeve 60 toward the annular resonator shell 50. While the illustrated embodiment shows three rows of resonator necks 102, other embodiments may include more rows, or fewer rows, of resonator necks 102. For example, the flow sleeve 60 may include 1, 2, 4, 5, or more rows of resonator necks 102. In certain embodiments, the number of rows of resonator necks 102 may be selected based on the range of frequencies of oscillations to be absorbed. Each row may include 6, 8, 10, 12, 14, 16, 18, 20, or more resonator necks 102. As discussed above, the resonator necks 102 may have different lengths 112 and/or cross-sectional diameters 150 circumferentially 46 about the flow sleeve 60 to enable the absorption of different frequencies of oscillations produced by combustion dynamics. Additionally, the resonator necks 102 in the illustrated embodiment are oriented in a rectangular grid configuration. As discussed below, other embodiments may include resonator necks 102 oriented in other configurations.

For example, FIG. 9 illustrates an embodiment of the combustor assembly 14 having a flow sleeve 60 with resonator necks 102 oriented in a staggered configuration. More specifically, the illustrated embodiment includes four rows of resonator necks 102, where each row is staggered with respect to adjacent rows of resonator necks 102. While the illustrated embodiment includes four staggered rows of resonator necks 102 disposed on the flow sleeve 60, other embodiments may include more or fewer rows. For example, other embodiments may include 2, 3, 5, 6, or more staggered rows of resonator necks. Additionally, each row may include 6, 8, 10, 12, 14, 16, 18, 20, or more resonator necks 102. As discussed above, the resonator necks 102 may have different lengths 112 and/or cross-sectional diameters 150 circumferentially 46 about the flow sleeve 60 to enable the absorption of different frequencies of oscillations produced by combustion dynamics. Similarly, while FIGS. 8 and 9 illustrate resonator necks 102 configurations for the flow sleeve 60, the illustrated configurations may be used for other components of the combustor assembly 14 which may have resonator necks 102, such as the fuel nozzles 20.

Figure 10:
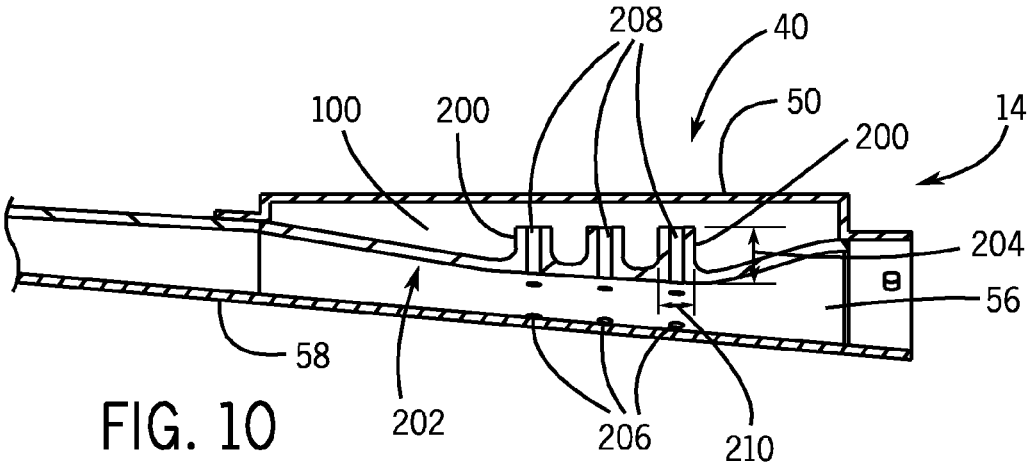
FIG. 10 is a partial cross-sectional view of an embodiment of the combustor resonator of FIG. 2, illustrating resonator passages defined by ribs and holes formed in the flow sleeve of the combustor assembly.

FIG. 10 is a partial cross-sectional side view of an embodiment of the combustor assembly 14, illustrating the combustor resonator 40 having resonator passages defined by ribs 200 (e.g., annular ribs) formed in the flow sleeve 60 of the combustor assembly 14. The illustrated embodiment includes similar elements and element numbers as the embodiment shown in FIG. 2. A portion 202 of the flow sleeve 60 includes a plurality of ribs 200, or grooves, formed circumferentially 46 about the flow sleeve 60. For example, the portion 202 may be a separate structure fused to the flow sleeve 60, e.g., by a welding or brazing process. Alternatively, the portion 202 may be integrally formed with the flow sleeve 60. While the illustrated embodiment of the portion 202 includes three ribs 200 formed about the flow sleeve 60, other embodiments may include 1, 2, 4, 5, 6, 7, 8, or more ribs 200. In certain embodiments, the ribs 200 may be formed by a machining process, such as milling. As shown, the ribs 200 have a radial height 204. In other words, the ribs 200 extend a distance (e.g., height 204) radially 44 outward from the flow sleeve 60. The height 204 of the ribs 200 may be constant about the circumference 46 of the flow sleeve 60, or the height 204 of the ribs 200 may vary. Additionally, holes 206 extend through the ribs 200. More particularly, the holes 206 define resonator passages 208 through the ribs 200 radially 44 outward from the flow sleeve 60. In this manner, the holes 206 and the ribs 200 represent the individual resonator necks 102 discussed above. In other words, the ribs 200 and holes 206 form resonator passages 208 between the annulus 56 and the annulus 100 (e.g., the resonator chamber). In certain embodiments of the combustor resonator 40, the flow sleeve 60 may include the individual resonator necks 102 discussed above and resonator passages 208 formed by ribs 200 with holes 206. As will be appreciated, the holes 206 may have similar or different diameters 210. In this manner, the resonator passages 208 may be tuned to mitigate a specific frequency range of combustion dynamics. Similarly, each rib 200 may have any number of holes 206. For example, each rib may have approximately 1-1000, 2 to 500, 3 to 250, 4 to 100, 5 to 50, or 6 to 25 holes 206. As with the embodiments described above, the annular resonator shell 50 may be disposed about the portion 202 of the flow sleeve 60 to provide an annulus 100 with a non uniform height.

Figure 11:
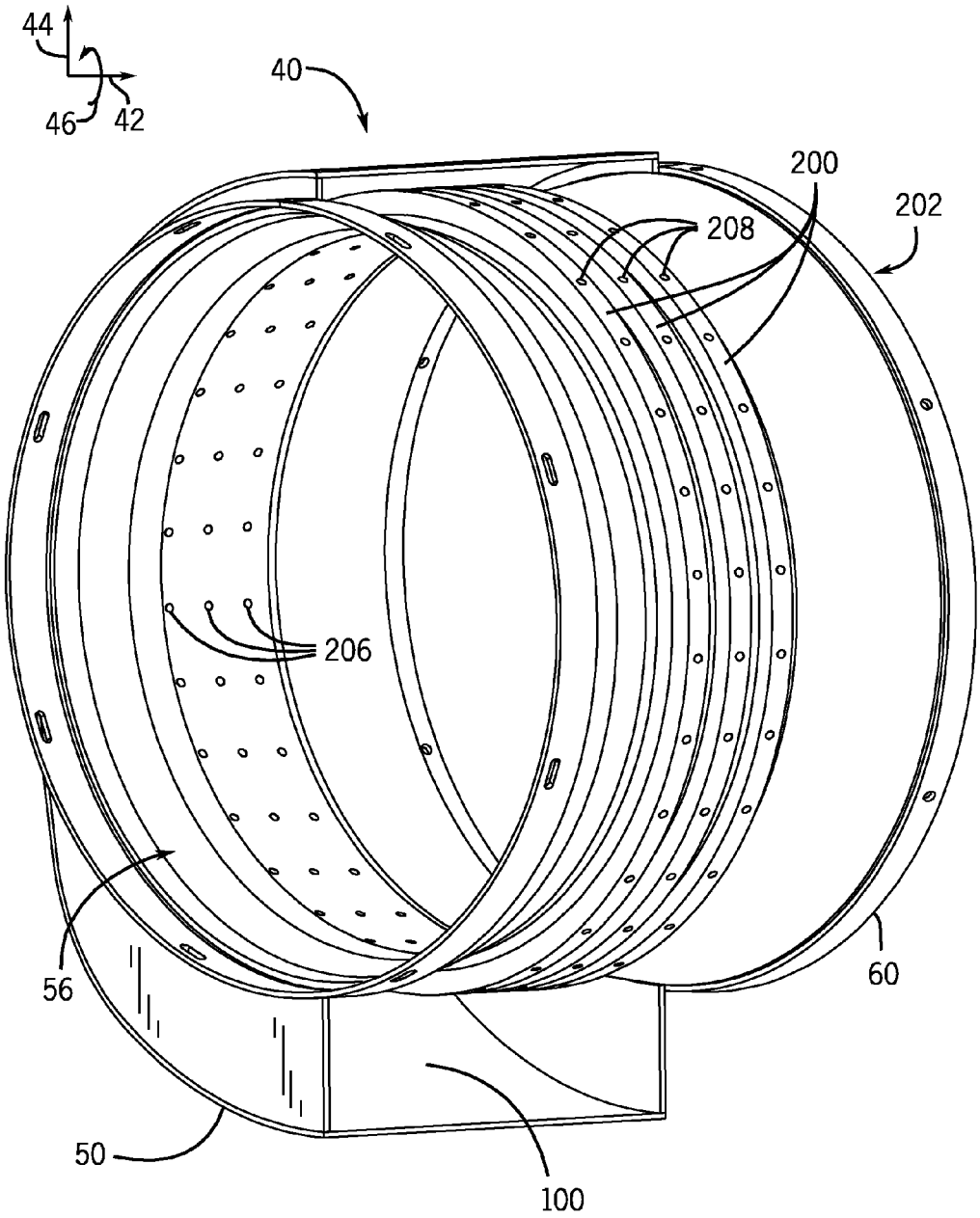
FIG. 11 is a partial perspective view of an embodiment of the combustor resonator of FIG. 2, illustrating resonator passages defined by ribs and holes formed in the flow sleeve of the combustor assembly.

FIG. 11 is a partial perspective view of the combustor resonator 40, illustrating an embodiment of resonator passages 208 formed by ribs 200 and holes 206. Specifically, the illustrated embodiment shows the portion 202 of the flow sleeve 60 having three ribs 200. As mentioned above, other embodiments of the combustor resonator 40 may include more or fewer ribs 200. Additionally, each rib 200 includes a plurality of holes 206 to create the resonator passages 208. As shown, the holes 206 extend through the ribs 200 in the radial 44 direction, thereby creating resonator passages 208 between the annulus 56 and the annulus 100 (e.g., the resonator chamber). As discussed above, the holes 206 may have different diameters 210, and the ribs 200 may have different heights 204, which may vary circumferentially 46 about the portion 202 of the flow sleeve 60 to enable the absorption of different frequencies of oscillations produced by combustion dynamics. Similarly, while FIGS. 10 and 11 illustrate resonator passages 208 formed in the portion 202 of the flow sleeve 60, resonator passages 208 may be formed by ribs 200 with holes 206 in other components of the combustor assembly 14, e.g., fuel nozzles 20 with a combustor resonator 40.

Figure 12:
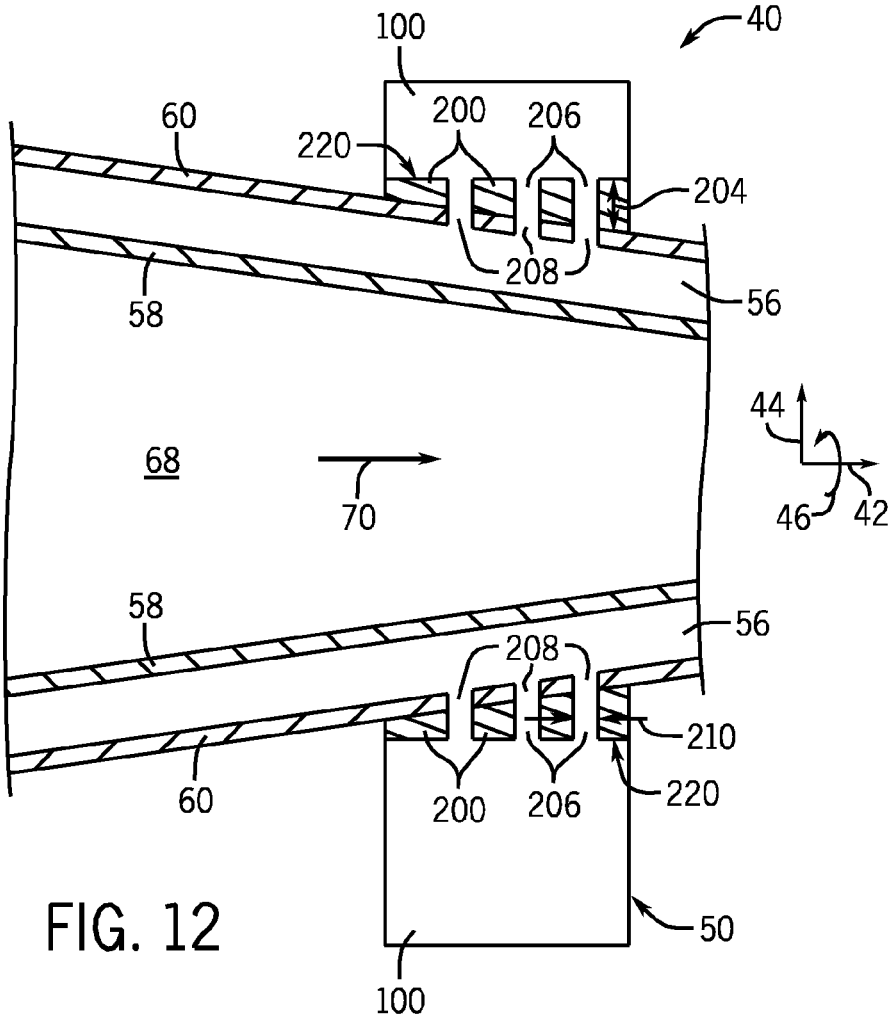
FIG. 12 is a partial perspective view of an embodiment of the combustor resonator of FIG. 2, illustrating resonator passages partially defined by ribs and holes formed in an inner wall of the resonator shell.

FIG. 12 is a partial perspective view of the combustor resonator 40, illustrating an embodiment of the resonator passages 208 formed by ribs 200 and holes 206. More specifically, in the illustrated embodiment, the ribs 200 and holes 206 are formed in an inner wall 220 of the annular resonator shell 50. In other words, the ribs 200 extend from the inner wall 220 of the annular resonator shell 50 to the flow sleeve 60. Additionally, the holes 206 extend through the flow sleeve 60 and the inner wall 220 of the annular resonator shell 50 in the radial 44 direction to form the resonator passages 208. In this manner, the annulus 56 between the liner 58 and the flow sleeve 60 is operatively coupled to the annulus 100 of the combustor resonator 40 (e.g., the resonator chamber). As discussed above, the holes 206 may have different diameters 210, and the ribs 200 may have different heights 204, which may vary in the axial 42 direction, as shown, to enable the absorption of different frequencies of oscillations produced by combustion dynamics. Similarly, the diameters 210 and heights 204 may vary circumferentially 46 about the inner wall 220 of the annular resonator shell 50.

As discussed above, the described embodiments provide a combustor resonator 40 having an annulus 100 with a non-uniform height. For example, the resonator 40 includes an annular resonator shell 50 which may be disposed about various components of the combustor assembly 14, such as the flow sleeve 60 or fuel nozzles 20. The combustor resonator 40 may also include resonator necks 102 or resonator passages 208 which are non-uniform. In other words, the resonator necks 102 or resonator passages 208 may have variable lengths and diameters. The non-uniform height of the annulus 100 and the non-uniform lengths and diameters of the resonator necks 102 or resonator passages 208 may help widen the frequency ranges over which the combustor resonator 40 is effective. In other words, embodiments of the combustor resonator 40 described herein may enable attenuation of combustion dynamics over a wider range of frequencies.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a combustor assembly comprising:

a liner; and a flow sleeve disposed about the liner, wherein the flow sleeve comprises a plurality of resonator passages; and a resonator coupled to the combustor assembly, wherein the resonator comprises a resonator shell extending circumferentially about the combustor assembly to define a resonator chamber, a radial distance between the resonator shell and the combustor assembly is non-uniform, each resonator passage of the plurality of resonator passages comprising a neck extending radially from the flow sleeve toward the resonator shell and a length of the neck varies from one resonator passage to another.

2. The system of claim 1, wherein each resonator passage of the plurality of resonator passages has a peripheral end at a radial offset from the resonator shell, and the radial offset varies from one resonator passage to another.

3. The system of claim 1, wherein each resonator passage of the plurality of resonator passages has a passage diameter or width, and the passage diameter or width varies from one resonator passage to another.

4. The system of claim 1, wherein each resonator passage of the plurality of resonator passages has a geometry, and the geometry varies from one resonator passage to another circumferentially about the combustor assembly.

5. The system of claim 1, wherein the radial distance between the resonator shell and the combustor assembly varies circumferentially about the combustor assembly.

6. A system, comprising:

a combustor resonator, comprising:

a flow sleeve comprising a plurality of resonator passages, wherein each resonator passage of the plurality of resonator passages has a length, and the length varies from one resonator passage to another; and a resonator shell disposed about the flow sleeve to define a resonator chamber, wherein a radial distance between the resonator shell and the flow sleeve is non-uniform, wherein each resonator passage of the plurality of resonator passages comprises a neck extending radially from the flow sleeve toward the resonator shell.

7. The system of claim 6, wherein each resonator passage of the plurality of resonator passages has a peripheral end at a radial offset from the resonator shell, and the radial offset varies from one resonator passage to another.

8. The system of claim 6, wherein each resonator passage of the plurality of resonator passages has a passage diameter or width, and the passage diameter or width varies from one resonator passage to another.

9. The system of claim 6, wherein each resonator passage of the plurality of resonator passages has a geometry, and the geometry varies from one resonator passage to another circumferentially about the flow sleeve.

10. A system, comprising:

a combustor resonator, comprising:

an inner wall disposed about an axis;

an outer wall disposed about the inner wall to define a resonator chamber, wherein a distance between the outer wall and the inner wall is non-uniform about a circumference of the combustor resonator; and a plurality of resonator passages extending radially outward from the inner wall toward the outer wall, wherein the resonator passages extend radially toward the outer wall by lengths that are non-uniform among the resonator passages.

11. The system of claim 10, wherein the inner wall comprises a flow sleeve of a combustor assembly.

12. The system of claim 10, wherein each resonator passage of the plurality of resonator passages comprises a neck extending radially outward from the inner wall toward the outer wall.

13. The system of claim 10, wherein radial gaps between peripheral ends of the resonator passages and the outer wall are constant among the resonator passages.

* * * * *